US010538967B2

(12) United States Patent
Savage et al.

(10) Patent No.: US 10,538,967 B2
(45) Date of Patent: Jan. 21, 2020

(54) BEARING ASSEMBLY FOR DRILLING A SUBTERRANEAN FORMATION

(71) Applicant: Halliburton Energy Services, Inc., Houston, TX (US)

(72) Inventors: John Keith Savage, Alberta (CA); Steven Graham Bell, Red Deer (CA); Neil Roy Choudhury, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/777,377

(22) PCT Filed: Dec. 30, 2015

(86) PCT No.: PCT/CA2015/051379

§ 371 (c)(1),
(2) Date: May 18, 2018

(87) PCT Pub. No.: WO2017/113002

PCT Pub. Date: Jul. 6, 2017

(65) Prior Publication Data

US 2019/0203536 A1 Jul. 4, 2019

(51) Int. Cl.
*E21B 4/00* (2006.01)

(52) U.S. Cl.
CPC ..... *E21B 4/003* (2013.01)

(58) Field of Classification Search
CPC ..... E21B 4/003
See application file for complete search history.

(56) References Cited

U.S. PATENT DOCUMENTS 4,260,031 A 4/1981 Jackson, Jr.
4,546,836 A 10/1985 Dennis et al.
5,168,941 A * 12/1992 Krueger ..... E21B 7/068 175/26
8,210,747 B2 7/2012 Cooley et al.
(Continued)

FOREIGN PATENT DOCUMENTS

WO 2009015338 A2 1/2009
WO 2012050674 A1 4/2012

OTHER PUBLICATIONS

PCT International Search Report and Written Opinion dated Sep. 15, 2016 issued in corresponding application No. PCT/CA2015/051379 filed on Dec. 30, 2015, 7 pgs.

*Primary Examiner* — Robert E Fuller
(74) *Attorney, Agent, or Firm* — Chamberlain Hrdlicka

(57) ABSTRACT

Various embodiments disclosed relate to bearing assembly for drilling a subterranean formation and methods of using the same. In various embodiments, the present invention provides a method of drilling a subterranean formation. The method includes flowing a drilling fluid through a drill string disposed in the subterranean formation, with the drill string including a bottom hole assembly including a bearing assembly including a low flow bearing. The method includes flowing a first part of the drilling fluid into contact with the low flow bearing, while simultaneously flowing a second part of the drilling fluid through a bypass channel around the low flow bearing. The method also includes discharging the first and second part of the drilling fluid between the bottom hole assembly and the subterranean formation.

18 Claims, 5 Drawing Sheets

(56) References Cited

U.S. PATENT DOCUMENTS

| | | | | |
|---|---|---|---|---|
| 8,807,837 | B1 * | 8/2014 | Gonzalez | F16C 17/04 384/303 |
| 8,834,026 | B2 | 9/2014 | Flores et al. | |
| 9,115,752 | B2 | 4/2015 | Wenzel | |
| 2006/0237234 | A1 | 10/2006 | Dennis et al. | |
| 2009/0196541 | A1 | 8/2009 | Johnson | |
| 2013/0299243 | A1 | 11/2013 | von Gynz-Rekowski et al. | |
| 2014/0037232 | A1 | 2/2014 | Merchand et al. | |
| 2014/0131105 | A1 | 5/2014 | Baugher et al. | |
| 2015/0096809 | A1 | 4/2015 | Kerstetter | |

* cited by examiner

BEARING ASSEMBLY FOR DRILLING A SUBTERRANEAN FORMATION

BACKGROUND

Drilling fluid carries drilling cuttings to the area outside the drill string and to the surface where they are crudely separated from the drilling fluid before pumping the fluid back down the inside of the drill string. This activity results in a fluid with suspended abrasive solid moving at high speed through components which make up a drilling tool in the bottom hole assembly (BHA). The issue is especially relevant for tools that utilize the fluid as a lubricant or coolant in load-bearing assemblies such as bearings. A fluid suspending solids and travelling at high speed tends to erode adjacent surfaces, a condition aggravated by increasing impingement angles. Bearing assemblies, such as those including particles of tungsten carbide suspended in a binder material, generally utilize mud as a lubricant/coolant and allow a portion of the total drill string flow to pass through the bearing pack. Emerging technologies utilizing polycrystalline diamond compact (PDC) bearing assemblies do not require the same volume of fluid. A common failure mode that reduces service life of this technology is erosion undermining the structure required to hold the diamond technology.

BRIEF DESCRIPTION OF THE FIGURES

The drawings illustrate generally, by way of example, but not by way of limitation, various embodiments discussed in the present document.

DETAILED DESCRIPTION OF THE INVENTION

Figure 1A:
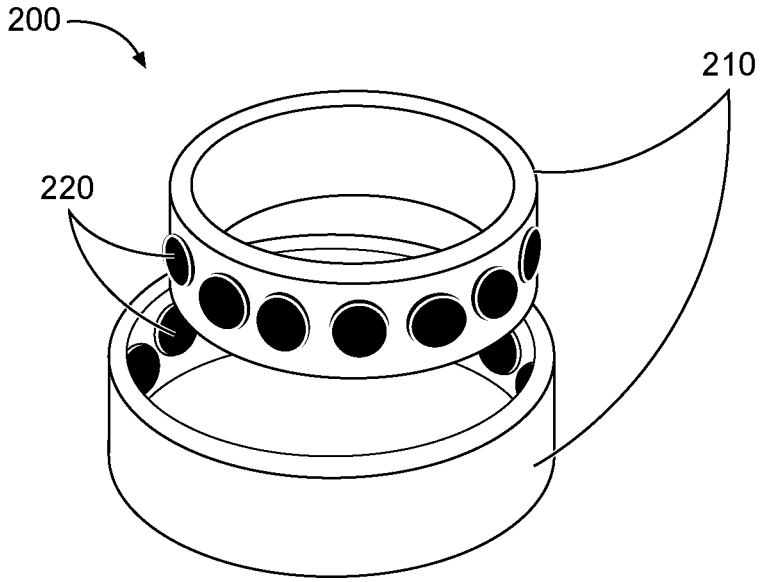
FIGS. 1A-D illustrate polycrystalline diamond bearings, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

In this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section. A comma can be used as a delimiter or digit group separator to the left or right of a decimal mark; for example, "0.000,1" is equivalent to "0.0001."

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

The term "downhole" as used herein refers to under the surface of the earth, such as a location within or fluidly connected to a wellbore.

As used herein, the term "drilling fluid" refers to fluids, slurries, or muds used in drilling operations downhole, such as during the formation of the wellbore.

As used herein, the term "water control material," "disproportionate permeability modifier," or "relative permeability modifier," refers to a solid or liquid material that interacts with aqueous material downhole, such that hydrophobic material can more easily travel to the surface and such that hydrophilic material (including water) can less easily travel to the surface. A water control material can be used to treat a well to cause the proportion of water produced to decrease and to cause the proportion of hydrocarbons produced to increase, such as by selectively binding together material between water-producing subterranean formations and the wellbore while still allowing hydrocarbon-producing formations to maintain output.

As used herein, the term "fluid" refers to liquids and gels, unless otherwise indicated.

As used herein, the term "subterranean material" or "subterranean formation" refers to any material under the surface of the earth, including under the surface of the bottom of the ocean. For example, a subterranean formation or material can be any section of a wellbore and any section of a subterranean petroleum- or water-producing formation or region in fluid contact with the wellbore. Placing a material in a subterranean formation can include contacting the material with any section of a wellbore or with any subterranean region in fluid contact therewith. Subterranean materials can include any materials placed into the wellbore such as cement, drill shafts, liners, tubing, casing, or screens; placing a material in a subterranean formation can include contacting with such subterranean materials. In some examples, a subterranean formation or material can be any below-ground region that can produce liquid or gaseous petroleum materials, water, or any section below-ground in fluid contact therewith. For example, a subterranean formation or material can be at least one of an area desired to be fractured, a fracture or an area surrounding a fracture, and a flow pathway or an area surrounding a flow pathway, wherein a fracture or a flow pathway can be optionally fluidly connected to a subterranean petroleum- or water-producing region, directly or through one or more fractures or flow pathways.

As used herein, "treatment of a subterranean formation" can include any activity directed to extraction of water or petroleum materials from a subterranean petroleum- or water-producing formation or region, for example, including drilling, stimulation, hydraulic fracturing, clean-up, acidizing, completion, cementing, remedial treatment, abandonment, and the like.

As used herein, a "flow pathway" downhole can include any suitable subterranean flow pathway through which two subterranean locations are in fluid connection. The flow pathway can be sufficient for petroleum or water to flow from one subterranean location to the wellbore or vice-versa. A flow pathway can include at least one of a hydraulic fracture, and a fluid connection across a screen, across gravel pack, across proppant, including across resin-bonded proppant or proppant deposited in a fracture, and across sand. A flow pathway can include a natural subterranean passageway through which fluids can flow. In some embodiments, a flow pathway can be a water source and can include water. In some embodiments, a flow pathway can be a petroleum source and can include petroleum. In some embodiments, a flow pathway can be sufficient to divert from a wellbore, fracture, or flow pathway connected thereto at least one of water, a downhole fluid, or a produced hydrocarbon.

In various embodiments, the present invention provides a method of drilling a subterranean formation. The method includes flowing a drilling fluid through a drill string disposed in the subterranean formation. The drill string includes a bottom hole assembly including a bearing assembly including a low flow bearing. The method includes flowing a first part of the drilling fluid into contact with the low flow bearing, while simultaneously flowing a second part of the drilling fluid through a bypass channel around the low flow bearing. The method also includes discharging the first and second part of the drilling fluid between the bottom hole assembly and the subterranean formation.

In various embodiments, the present invention provides a method of drilling a subterranean formation. The method includes flowing a drilling fluid through a drill string disposed in the subterranean formation. The drill string includes a bottom hole assembly including bearing assembly and a drill bit section. The drill bit section is at a downhole end of the bottom hole assembly. The bearing assembly includes a high flow bearing and a low flow bearing. The low flow bearing is more proximate to the drill bit section than the high flow bearing. At least one bearing surface of the low flow bearing includes diamond. The method includes flowing a first part of the drilling fluid and a second part of the drilling fluid together into contact with the high flow bearing, including cooling the high flow bearing with the first and second parts of the drilling fluid, lubricating the high flow bearing with the first and second parts of the drilling fluid, or a combination thereof. The method includes flowing the first part of the drilling fluid into contact with the low flow bearing, including cooling the low flow bearing with the first part of the drilling fluid, lubricating the low flow bearing with the first part of the drilling fluid, or a combination thereof, while simultaneously flowing the second part of the drilling fluid through a bypass channel around the low flow bearing. The method also includes discharging the first and second part of the drilling fluid between the bottom hole assembly and the subterranean formation.

In various embodiments, the present invention provides a bearing assembly for drilling a subterranean formation. The bearing assembly includes an inlet configured to flow a drilling fluid into the bearing assembly. The bearing assembly includes a low flow bearing. The bearing assembly includes a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing. The bearing assembly includes a first outlet configured to discharge the first part of the drilling fluid that contacted the low flow bearing externally to the bearing assembly. The bearing assembly also includes a bypass outlet configured to discharge the second part of the drilling fluid that flowed through the bypass channel externally to the bearing assembly.

In various embodiments, the present invention provides a bearing assembly for drilling a subterranean formation. The bearing assembly includes an inlet configured to flow a first part and a second part of a drilling fluid into the bearing assembly. The bearing assembly includes a low flow bearing. The bearing assembly includes a high flow bearing, wherein the bearing assembly is configured to flow the first part and the second part of the drilling fluid flowed into the bearing assembly through the inlet into contact with the high flow bearing, to cool the high flow bearing with the first and second parts of the drilling fluid, to lubricate the high flow bearing with the first and second parts of the drilling fluid, or a combination thereof. The bearing assembly includes a bypass channel configured to flow the first part of the drilling fluid that has contacted the high flow bearing into contact with the low flow bearing to cool the low flow bearing with the first part of the drilling fluid, lubricate the low flow bearing with the first part of the drilling fluid, or a combination thereof, and to simultaneously flow the second part of the drilling fluid that has contacted the high flow bearing through the bypass channel around the low flow bearing. The bearing assembly includes a first outlet configured to discharge the first part of the drilling fluid that contacted the low flow bearing externally to the bearing assembly. The bearing assembly also includes a bypass outlet configured to discharge the second part of the drilling fluid that flowed through the bypass channel externally to the bearing assembly.

In various embodiments, the present invention provides a system for drilling a subterranean formation. The system includes a pump configured to pump a drilling fluid in a drill string disposed in the subterranean formation. The system also includes a bottom hole assembly at the downhole end of the drilling string, the bottom hole assembly including a bearing assembly. The bearing assembly includes an inlet configured to flow the drilling fluid into the bearing assembly. The bearing assembly includes a low flow bearing. The bearing assembly includes a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing. The bearing assembly includes a first outlet configured to discharge the first part of the drilling fluid that contacted the low flow bearing externally to the bearing assembly. The bearing assembly also includes a bypass outlet configured to discharge the second part of the drilling fluid that flowed through the bypass channel externally to the bearing assembly.

Various embodiments of the present invention have certain advantages over other bearing assemblies and methods of using the same. For example, in various embodiments, the bypass channel of the bearing assembly decreases mud flow through one or more bearings in the bearing assembly, such as a PDC bearing, reducing the rate of erosion and degradation of the bearing and extending the service life of the bearing. In various embodiments, the bypass channel allows some bearings in the bearing assembly to receive a greater amount of mud flow than other bearings that are bypassed by the bypass channel, simultaneously providing the flow required for bearings requiring greater flow while not exceeding the flow required by bearings requiring less flow, such as PDC bearings. In various embodiments, the bypass channel allows upper bearings to receive a greater amount of mud flow than lower bearings bypassed by the bypass channel, simultaneously providing the flow required to the upper bearings while not exceeding the flow required by the lower bearings, such as PDC bearings. In various embodiments, the bearing assembly can provide a longer service life before bearings therein need to be serviced or replaced, such as bearings having reduced mud flow requirements compared to other bearings in the bearing assembly, such as PDC bearings. Bearings having reduced flow requirements, such as PDC bearings, can be more expensive than other bearings; in various embodiments, the bearing assembly can increase the service life of the most expensive bearings in the bearing assembly, improving the economics of using the bearing assembly over using other bearing assemblies that include bearings that have reduced flow requirements.

Method of Drilling a Subterranean Formation.

In various embodiments, the present invention provides a method of drilling a subterranean formation. The method can be any suitable method of using an embodiment of the bearing assembly described herein for drilling of a subterranean formation. The method can include flowing a drilling fluid through a drill string disposed in the subterranean formation. Herein, "flowing" a fluid can refer to directing a flow of the fluid. The drill string can include a bottom hole assembly including a bearing assembly. The bearing assembly can include a low flow bearing. The method can include flowing a first part of the drilling fluid into contact with the low flow bearing, while simultaneously flowing a second part of the drilling fluid through a bypass channel around the low flow bearing. The method can also include discharging the first and second part of the drilling fluid between the bottom hole assembly and the subterranean formation.

The method can include flowing a drilling fluid through a drill string disposed in the subterranean formation. The drill string can include a bottom hole assembly at the downhole end of the drill string. The bottom hole assembly can include a bearing assembly. The bottom hole assembly can also include a power section and a drill bit section. The power section can be any suitable power section, such as including a mud motor, a turbine, or an electric motor. In some embodiments, the method includes flowing the drilling fluid through the power section before flowing the first part of the drilling fluid into contact with the low flow bearing and flowing the second part of the drilling fluid through the bypass channel around the low flow bearing.

The bearing assembly can include a low flow bearing. The low flow bearing can have any suitable location within the bearing assembly. The low flow bearing can be at a downhole end of the bearing assembly, such as at an end of the bearing assembly that is adjacent a drill bit section. The low flow bearing can be the most downhole bearing in the bearing assembly; e.g., the low flow bearing can be more proximate to the drill bit section than any other bearing in the bearing assembly. In some embodiments, the bearing assembly includes a plurality of low flow bearings. The plurality of low flow bearings can be located at the downhole end of the bearing assembly, and can be more proximate to the drill bit section than any other bearing in the bearing assembly. In some embodiments, the low flow bearing is not the most downhole bearing in the bearing assembly. In some embodiments, the low flow bearing is proximate a power section of the bottom hole assembly.

The method can include flowing a first part of the drilling fluid into contact with the low flow bearing, while simultaneously flowing a second part of the drilling fluid through a bypass channel around the low flow bearing. The bypass channel can direct a portion of the drilling fluid (e.g., the second part) away from and around the low flow bearing, while another portion of the drilling fluid (e.g., the first part) contacts the low flow bearing. Flowing the first part of the drilling fluid into contact with the low flow bearing can include contacting the first part of the drilling fluid with bearing surfaces of the low flow bearing, surfaces adjacent to bearing surfaces of the low flow bearing, or a combination thereof. Flowing the first part of the drilling fluid into contact with the low flow bearing can include cooling the low flow bearing with the first part of the drilling fluid, lubricating the low flow bearing with the first part of the drilling fluid, or a combination thereof.

The bypass channel can direct the second part of the drilling fluid away from and around the low flow bearing. During the flowing of the second part of the drilling fluid through the bypass channel around the low flow bearing, the low flow bearing can be substantially free of lubrication and cooling from the second part of the drilling fluid (e.g., bearing surfaces of the low flow bearing, structural components of the low flow bearing, or a combination thereof). During the flowing of the second part of the drilling fluid through the bypass channel around the low flow bearing, the low flow bearing can be substantially free of contact with the second part of the drilling fluid. The bypass channel can be between the bearing and the exterior of the bearing assembly, such that flowing the second part of the drilling fluid through the bypass channel includes flowing the second part of the drilling fluid externally to the low flow bearing and internally to the bottom hole assembly.

In various embodiments, the method can include modulating the amount of the drilling fluid that enters the bypass channel. The modulation can include setting or placing a flow restrictor in the bearing assembly above-surface. In some embodiments, the modulation can include controlling a flow restrictor, or controlling a valve, while the bearing assembly is downhole.

In some embodiments, the bearing assembly includes a plurality of bypass channels. The method can include flowing a first part of the drilling fluid into contact with the low flow bearing, while simultaneously flowing a second part of the drilling fluid through a plurality of bypass channels around the low flow bearing.

In some embodiments, the bearing assembly includes a plurality of low flow bearings. The method can include flowing the first part of the drilling fluid into contact with each of the plurality of the low flow bearings, while simultaneously flowing a second part of the drilling fluid through the bypass channel around each of the low flow bearings.

The bearing assembly can further include a high flow bearing. The method can include flowing the first and second part of the drilling fluid together (e.g., simultaneously) into contact with the high flow bearing. The method can include flowing the first and second part of the drilling fluid together into contact with the high flow bearing before simultaneously flowing the first part of the drilling fluid into contact with the low flow bearing and flowing the second part of the drilling fluid through the bypass channel around the low flow bearing. The method can include flowing the first and second part of the drilling fluid together into contact with the high flow bearing (e.g., simultaneously contacting the high flow bearing) after simultaneously flowing the first part of the drilling fluid into contact with the low flow bearing and flowing the second part of the drilling fluid through the bypass channel around the low flow bearing. Flowing the first and second parts of the drilling fluid together into contact with the high flow bearing can include contacting the first and second parts of the drilling fluid together with bearing surfaces of the high flow bearing, surfaces adjacent to bearing surfaces of the high flow bearing, or a combination thereof. Flowing the first and second parts of the drilling fluid together into contact with the high flow bearing can include cooling the high flow bearing with the first and second parts of the drilling fluid, lubricating the high flow bearing with the first and second parts of the drilling fluid, or a combination thereof.

The high flow bearing can have any suitable location within the bearing assembly. The high flow bearing can be at an uphole end of the bearing assembly, such as at an end of the bearing assembly that is adjacent to or most proximate to a power section. The low flow bearing can be located closer to the downhole end of the bearing assembly than the high flow bearing. The low flow bearing can be located more proximate to the drill bit section than the high flow bearing. A central axis of the high flow bearing can be approximately aligned with a central axis of the low flow bearing. The axis defined by the high flow bearing and the low flow bearing can be the same as the central axis of the bearing assembly (e.g., of the bearing house), or the axis defined by the high flow bearing and the low flow bearing can be tilted with respect to the central axis of the bearing assembly. In some embodiments, the high flow bearing can be at a downhole end of the bearing assembly, such as at an end of the bearing assembly that is adjacent to or most proximate to a drill bit section. The high flow bearing can be located closer to the downhole end of the bearing assembly than the low flow bearing. The high flow bearing can be located more proximate to the drill bit section than the low flow bearing.

The bearing assembly can include a plurality of high flow bearings. The method can include flowing the first and second part of the drilling fluid together into contact with the plurality of high flow bearings before simultaneously flowing the first part of the drilling fluid into contact with the low flow bearing and flowing the second part of the drilling fluid through the bypass channel around the low flow bearing.

The method can include discharging the first and second part of the drilling fluid between the bottom hole assembly and the subterranean formation. Discharging the first and second part of the drilling fluid between the bottom hole assembly and the subterranean formation can include discharging the first and second part of the drilling fluid to different locations. Discharging the first and second part of the drilling fluid between the bottom hole assembly and the subterranean formation can include flowing the first part of the drilling fluid into a drill bit section of the bottom hole assembly, and then discharging the first part of the drilling fluid from the drill bit section to between the bottom hole assembly and the subterranean formation. Discharging the first and second part of the drilling fluid between the bottom hole assembly and the subterranean formation can include discharging the second part of the drilling fluid to between the bottom hole assembly and the subterranean formation without flowing the second part of the drilling fluid into a drill bit section of the bottom hole assembly. Discharging the first and second part of the drilling fluid between the bottom hole assembly and the subterranean formation can include discharging the second part of the drilling fluid between the bottom hole assembly and the subterranean formation through a bypass outlet in the bottom hole assembly. The bypass outlet can be uphole of a drill bit section of the bottom hole assembly. In embodiments wherein the first and second part of the drilling fluid are flowed to the high flow bearing after being simultaneously contacted with the low flow bearing, the discharging can including discharging the first and second part of the drilling fluid into the drill bit section.

The method can include flowing less than 100 wt % of the drilling fluid that flowed through the drill string into the bearing assembly. For example, 0.01 wt % to about 100 wt % of the drilling fluid that flowed through the drill string can be flowed into the bearing assembly, or about 0.01 wt % or less, or less than, equal to, or greater than about 0.1 wt %, 1, 2, 3, 4, 5, 6, 8, 10, 12, 14, 16, 18, 20, 25, 30, 35, 40, 45, 50, 55, 60, 65, 70, 75, 80, 82, 84, 86, 88, 90, 91, 92, 93, 94, 95, 96, 97, 98, 99, 99.9 wt %, or about 99.99 wt % or more. The first part and second part of the drilling fluid combined can be any suitable proportion of the drilling fluid that flowed through the drill string, and can be any suitable proportion of the drilling fluid that flowed through the drill string and that entered the bearing assembly, such as 0.01 wt % to about 100 wt %, or about 0.01 wt % or less, or less than, equal to, or greater than about 0.1 wt %, 1, 2, 3, 4, 5, 6, 8, 10, 12, 14, 16, 18, 20, 25, 30, 35, 40, 45, 50, 55, 60, 65, 70, 75, 80, 82, 84, 86, 88, 90, 91, 92, 93, 94, 95, 96, 97, 98, 99, 99.9 wt %, or about 99.99 wt % or more. The first portion of the drilling fluid can be any suitable proportion of the drilling fluid that flowed through the drill string, and can be any suitable proportion of the drilling fluid that flowed through the drill string and that entered the bearing assembly, such as about 0.01 wt % to about 99.99 wt %, or about 0.01 wt % or less, or less than, equal to, or greater than about 0.1 wt %, 1, 2, 3, 4, 5, 6, 8, 10, 12, 14, 16, 18, 20, 25, 30, 35, 40, 45, 50, 55, 60, 65, 70, 75, 80, 82, 84, 86, 88, 90, 91, 92, 93, 94, 95, 96, 97, 98, 99, 99.9 wt %, or about 99.99 wt % or more. The second portion of the drilling fluid can be any suitable proportion of the drilling fluid that flowed through the drill string, and can be any suitable proportion of the drilling fluid that flowed through the drill string that entered the bearing assembly, such as about 0.01 wt % to about 99.99 wt %, or about 0.01 wt % or less, or less than, equal to, or greater than about 0.1 wt %, 1, 2, 3, 4, 5, 6, 8, 10, 12, 14, 16, 18, 20, 25, 30, 35, 40, 45, 50, 55, 60, 65, 70, 75, 80, 82, 84, 86, 88, 90, 91, 92, 93, 94, 95, 96, 97, 98, 99, 99.9 wt %, or about 99.99 wt % or more.

Low Flow Bearing.

The bearing assembly can include a low flow bearing. The designation of a bearing as "low flow" can indicate that the bearing has lower mud flow requirements for lubrication and cooling relative to other bearings, such as relative to other bearings in the bearing assembly, such as relative to high flow bearings in the bearing assembly. As used herein, a "bearing" is a machine element that substantially constrains relative motion to only a desired motion and that reduces friction between moving parts. The "bearing surfaces" of a bearing are the load-bearing surfaces of the bearing that experience friction during the desired motion.

The low flow bearing can be any suitable bearing. The low flow bearing can be a radial bearing (e.g., load-bearing surfaces designed to handle lateral forces between the drill bit section and the drill string, designed to prevent lateral motion of the drill bit section relative to the drill string), a thrust bearing (e.g., load-bearing surfaces designed to handle compressive or tensile forces between the drill bit section and the drill string), an on-bottom bearing (e.g., load-bearing surfaces designed to handle friction caused by compressive force between the drill bit section pressing and the drill string, such as by the drill bit section resting or pressing on the bottom), an off-bottom bearing (e.g., load-bearing surfaces designed to handle friction caused by tension between the drill bit and the drill string, such as caused by the drill bit being lifted off the bottom or used for a reaming operation), or a combination thereof. In some embodiments, the low flow bearing is a radial bearing.

The low flow bearing can include any suitable material. In some embodiments, the low flow bearing includes a structural material that forms the majority of the bearing, with a harder and more friction-tolerant material on the bearing surfaces of the bearing. The low flow bearing can include cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof. The low flow bearing can include pucks including tungsten carbide (e.g., tungsten carbide suspended in a binder), wherein each puck includes a bearing surface of the low flow bearing. The bearing surfaces of the pucks can stand proud of the surface of the structural material that forms the majority of the bearing. The pucks can be attached to the structural material of the bearing in any suitable way, such as via brazing. The bearing surfaces of the low flow bearing can include diamond, such as polycrystalline diamond (e.g., diamond grit that has been fused together under high-pressure, high-temperature conditions in the presence of a catalytic metal). The low flow bearing can be a polycrystalline diamond compact (PDC) bearing assembly.

Figure 1B:
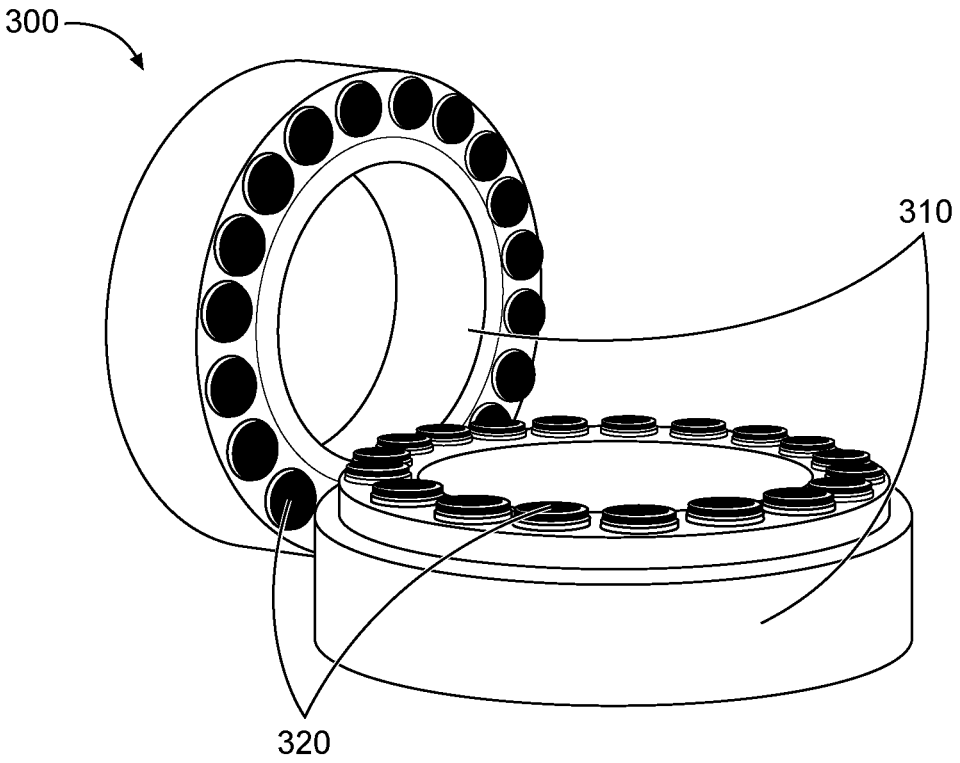
Figure 1C:
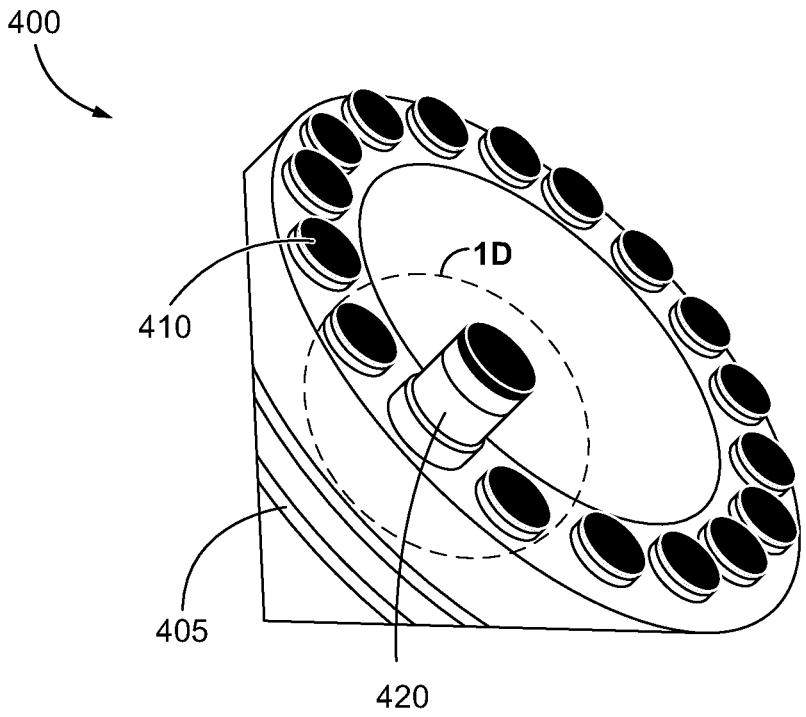
Figure 1D:
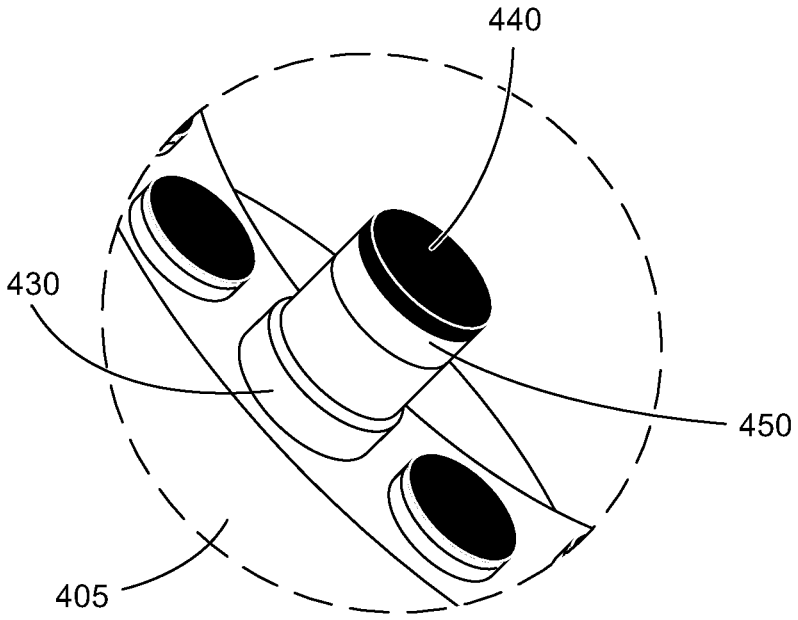

FIG. 1A illustrates a low flow polycrystalline diamond radial bearing 200. The halves of the bearing 200 are shown separated to show detail. The bearing 200 includes structural material 210 and polycrystalline-coated tungsten carbide pucks 220. FIG. 1B illustrates a low flow polycrystalline diamond thrust bearing 300. The halves of the bearing 300 are shown separated to show detail. The bearing 300 includes structural material 310 and polycrystalline-coated tungsten carbide pucks 320. FIG. 1C illustrates a low flow polycrystalline diamond thrust bearing 400 (only one half of the bearing 400 is shown). The bearing 400 includes structural material 405 and polycrystalline-coated tungsten carbide pucks 410. Puck 420 is shown removed from the structural material 405 to show detail, and an exploded view is shown. In the exploded view, puck 420 is brazed 430 to the structural material 405. The puck includes a tungsten carbide body 450 (e.g., tungsten carbide suspended in a binder) with a polycrystalline diamond coating 440 on the bearing-surfaces of the puck.

High Flow Bearing.

In addition to the low flow bearing, the bearing assembly can further include a high flow bearing. The designation of a bearing as "high flow" can indicate that the bearing has higher mud flow requirements for lubrication and cooling relative to other bearings, such as relative to other bearings in the bearing assembly, such as relative to a low flow bearing in the bearing assembly. The high flow bearing can be any suitable bearing. The high flow bearing can be a plain bushing, a radial bearing, a thrust bearing, an on-bottom bearing, an off-bottom bearing, or a combination thereof. The high flow bearing can be a plain bushing.

The high flow bearing can include any suitable material. In some embodiments, the high flow bearing includes a structural material that forms that majority of the bearing, with a harder and more friction-tolerant material on the bearing surfaces of the bearing. The high flow bearing can include cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof. At least one bearing surface of the high flow bearing can include tungsten carbide.

Bearing Assembly for Drilling a Subterranean Formation.

In various embodiments, the present invention provides a bearing assembly for drilling a subterranean formation. The bearing assembly can be any suitable bearing assembly that can be used to perform an embodiment of the method for drilling a subterranean formation described herein. The bearing assembly can include an inlet configured to flow a drilling fluid into the bearing assembly. Herein, "to flow" a fluid can refer to directing a flow of the fluid. The bearing assembly can include a low flow bearing. The bearing assembly can include a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing. The bearing assembly can include a first outlet configured to discharge the first part of the drilling fluid that contacted the low flow bearing externally to the bearing assembly. The bearing assembly can also include a bypass outlet configured to discharge the second part of the drilling fluid that flowed through the bypass channel externally to the bearing assembly.

Figure 2:
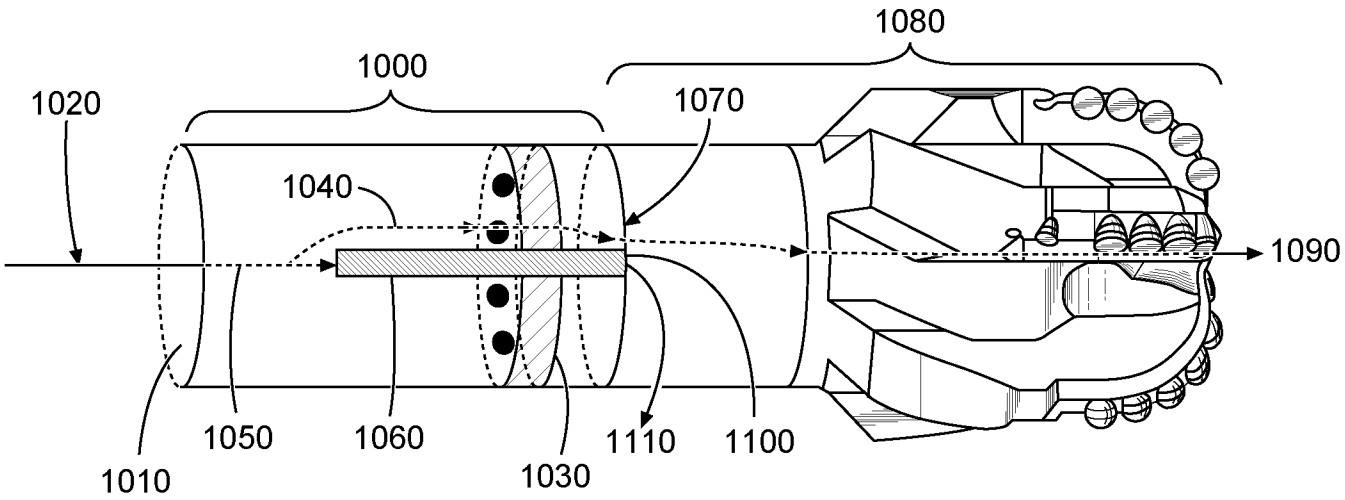
FIG. 2 illustrates a bearing assembly, in accordance with various embodiments.

FIG. 2 illustrates an embodiment of a bearing assembly 1000 for drilling a subterranean formation. The bearing assembly 1000 can include an inlet 1010 configured to flow a drilling fluid 1020 into the bearing assembly 1000. The bearing assembly 1000 can include a low flow bearing 1030. The bearing assembly 1000 can include a bypass channel 1060 configured to flow a first part 1040 of the drilling fluid flowed into the bearing assembly 1000 into contact with the low flow bearing 1030 and to simultaneously flow a second part 1050 of the drilling fluid flowed into the bearing assembly 1000 through the bypass channel 1060 around the low flow bearing 1030. The bearing assembly 1000 can include a first outlet 1070 configured to discharge the first part 1040 of the drilling fluid that contacted the low flow bearing 1030 externally to the bearing assembly, such as through a drill bit section 1080 and externally 1090 to the drill bit section 1080. The bearing assembly 1000 can also include a bypass outlet 1100 configured to discharge the second part 1050 of the drilling fluid that flowed through the bypass channel 1060 externally 1110 to the bearing assembly 1000.

Flowing the first part of the drilling fluid into contact with the low flow bearing can include cooling the low flow bearing with the first part of the drilling fluid, lubricating the low flow bearing with the first part of the drilling fluid, or a combination thereof. Flowing the first part of the drilling fluid into contact with the low flow bearing can include contacting the first part of the drilling fluid with bearing surfaces of the low flow bearing, surfaces adjacent to bearing surfaces of the low flow bearing, or a combination thereof.

During the flowing of the second part of the drilling fluid through the bypass channel around the low flow bearing, the bearing assembly can be configured such that the low flow bearing is substantially free of lubrication and cooling from the second part of the drilling fluid. During the flowing of the second part of the drilling fluid through the bypass channel around the low flow bearing, the bearing assembly can be configured such that the low flow bearing is substantially free of contact with the second part of the drilling fluid. The bypass channel can be external to the low flow bearing and internal to the bearing assembly.

In some embodiments, the bearing assembly can include a flow restrictor or valve that can control or modulate the amount of the drilling fluid that enters the bypass channel. In some embodiments, the bearing assembly includes a flow restrictor that controls the proportion of fluid that enters the bypass channel (e.g., the second part of the drilling fluid) versus the proportion of fluid that does not enter the bypass channel (e.g., the first part of the drilling fluid). The flow restrictor can be placed or set into the bearing assembly above-surface, or in some embodiments can be controlled (e.g., flow can be modulated) while the bearing assembly is in the subterranean formation. In some embodiments, the flow restrictor can be a plug that can be inserted in one or more bypass channels. In some embodiments, the flow restrictor can be a valve that occurs at or near the entrance to one or more of the bypass channels.

The bearing assembly can include a plurality of the bypass channels, with the bypass channels together configured to flow a first part of the drilling fluid flowed into the bearing assembly into contact with the low flow bearing and to simultaneously flow a second part of the drilling fluid flowed into the bearing assembly through the bypass channels around the low flow bearing.

The low flow bearing can be located in any suitable location in the bearing assembly. The low flow bearing can be included in an end of the bearing assembly opposite the inlet. The low flow bearing can be configured to be more proximate to a drill bit section than any other bearing in the bearing assembly. In other embodiments, the low flow bearing can be included in an end of the bearing assembly proximate the inlet. The low flow bearing can be configured to be more proximate to a power section than any other bearing in the bearing assembly.

The bearing assembly can include a plurality of low flow bearings. The bypass channel can be configured to flow a first part of the drilling fluid flowed into the bearing assembly into contact with the plurality of low flow bearings and to simultaneously flow a second part of the drilling fluid flowed into the bearing assembly through the bypass channel around the plurality of low flow bearings.

The central axis of the low flow bearing can be aligned with the central axis of the high flow bearing. In some embodiments, the bearing assembly can be configured such that the axis defined by the high flow bearing and the low flow bearing can be aligned with the central axis of the bearing assembly. In some embodiments, the axis defined by the high flow bearing and the low flow bearing can be tilted with respect to the central axis of the bearing assembly, such that one side of the walls of the bearing assembly that hold the exterior of the low flow bearing are be thicker than the opposite side of the walls. In such embodiments, the bypass channel can be located in the thicker section of the walls of the bearing assembly. The bypass channel can be located in a thicker section of the walls of the bearing assembly that is not directly opposite the thinnest section, to avoid placing the bypass channels in sections of the wall that experience the most extreme forces during drilling operations. For example, the bypass channel can be located about 1/20 to about 1/4 of the circumference of the walls away from the thickest portion of the wall, or about 1/20 or less, or less than, equal to, or greater than about 1/19 of the circumference from the thickest portion, 1/18, 1/17, 1/16, 1/15, 1/14, 1/13, 1/12, 1/11, 1/10, 1/9, 1/8, 1/7, 1/6, 1/5, 1/4, or about 1/3 of the circumference from the thickest portion or more. In embodiments having multiple bypass channels, the bypass channels can be arranged symmetrically around the thickest portion of the walls.

The bearing assembly can include a high flow bearing. The bearing assembly can be configured to flow the first and second part of the drilling fluid together into contact with the high flow bearing. The bearing assembly can be configured to flow the first and second part of the drilling fluid together into contact with the high flow bearing and to subsequently simultaneously flow the first part of the drilling fluid into contact with the low flow bearing and flow the second part of the drilling fluid through the bypass channel around the low flow bearing. During the flowing of the first and second parts of the drilling fluid together into contact with the high flow bearing, the bearing assembly can be configured such that the first and second parts of the drilling fluid together are contacted with bearing surfaces of the high flow bearing, surfaces adjacent to bearing surfaces of the high flow bearing, or a combination thereof. During the flowing of the first and second parts of the drilling fluid together into contact with the high flow bearing, the bearing assembly can be configured such that the high flow bearing is cooled with the first and second parts of the drilling fluid, the high flow bearing is lubricated with the first and second parts of the drilling fluid, or a combination thereof.

The bearing assembly can include a plurality of high flow bearings. The bearing assembly can be configured to flow the first and second part of the drilling fluid together into contact with the plurality of high flow bearings and to subsequently simultaneously flow the first part of the drilling fluid into contact with the low flow bearing and flow the second part of the drilling fluid through the bypass channel around the low flow bearing.

A central axis of the high flow bearing can be approximately aligned with a central axis of the low flow bearing. The axis defined by the high flow bearing and the low flow bearing can be aligned with the central axis of the bearing assembly, or the axis defined by the high flow bearing and the low flow bearing can be tilted with respect to the central axis of the bearing assembly, with an angle therebetween of about 1 to about 10 degrees, or about 1 to about 5 degrees, or about 0 degrees, or about 1 degree or less, or less than, equal to, or greater than about 2 degrees, 3, 4, 5, 6, 7, 8, 9, or about 10 degrees or more.

The high flow bearing can be more proximate to an end of the bearing assembly including the inlet than the low flow bearing. The low flow bearing can be configured to be more proximate to a drill bit section than the high flow bearing. In other embodiments, the low flow bearing can be more proximate to an end of the bearing assembly including the inlet than the high flow bearing. The high flow bearing can be configured to be more proximate to a drill bit section than the low flow bearing.

The first outlet can be configured to discharge the first part of the drilling fluid that contacted the low flow bearing to a drill bit section. The bypass outlet can be configured to discharge the second part of the drilling fluid that flowed through the bypass channel between the bottom hole assembly and the subterranean formation. In embodiments wherein the first and second part of the drilling fluid are flowed to the high flow bearing after the first part of the drilling fluid is contacted with the low flow bearing and the second part of the drilling fluid is contacted with the high flow bearing, the first and second parts of the drilling fluid can emerge through the same outlet (e.g., the first outlet and the bypass outlet can be the same outlet), such as an outlet that emerges from the high flow bearing (e.g., with discharge into the drill bit section, to another location, or a combination thereof).

Figure 3:
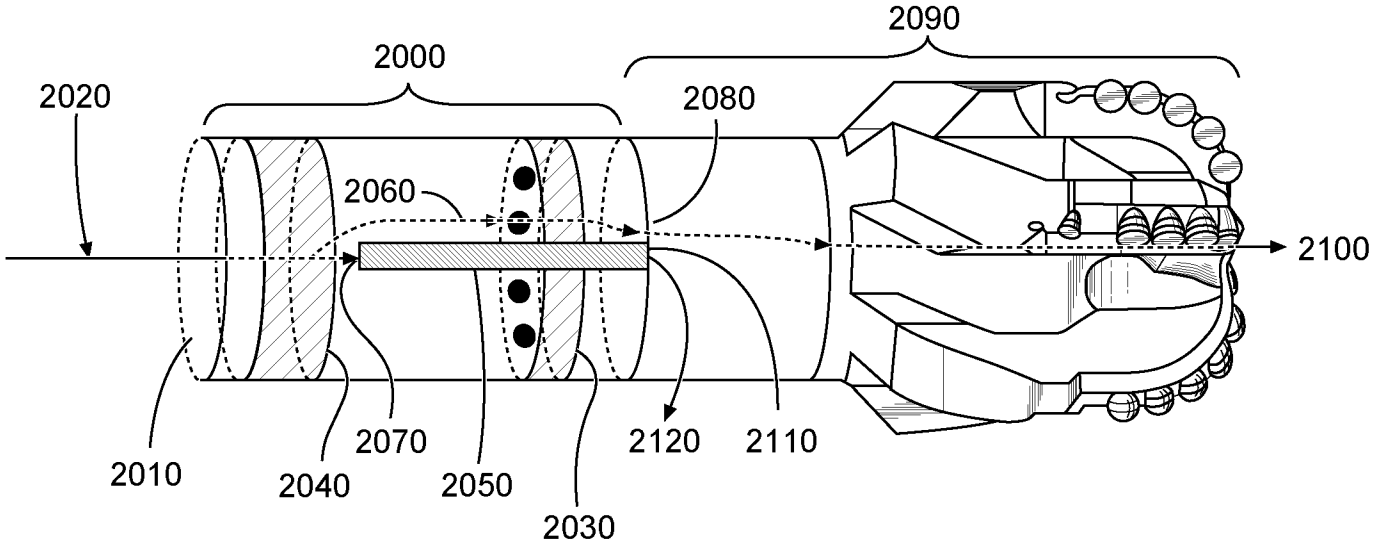
FIG. 3 illustrates a bearing assembly, in accordance with various embodiments.

FIG. 3 illustrates an embodiment of a bearing assembly 2000 for drilling a subterranean formation. The bearing assembly 2000 includes an inlet 2010 configured to flow a first part and a second part of a drilling fluid (first part and second part are shown together as 2020) into the bearing assembly. The bearing assembly 2000 includes a low flow bearing 2030. The bearing assembly 2000 includes a high flow bearing 2040. The bearing assembly 2000 is configured to flow the first part and the second part of the drilling fluid 2020 flowed into the bearing assembly 2000 through the inlet 2010 into contact with the high flow bearing 2040, to cool the high flow bearing 2040 with the first part and second part of the drilling fluid 2020, to lubricate the high flow bearing 2040 with the first part and second part of the drilling fluid 2020, or a combination thereof. The bearing assembly 2000 includes a bypass channel 2050 configured to flow the first part 2060 of the drilling fluid that has contacted the high flow bearing 2040 into contact with the low flow bearing 2030 to cool the low flow bearing 2030 with the first part 2060 of the drilling fluid, lubricate the low flow bearing 2030 with the first part 2060 of the drilling fluid, or a combination thereof, and to simultaneously flow the second part 2070 of the drilling fluid that has contacted the high flow bearing 2040 through the bypass channel 2050 around the low flow bearing 2030. The bearing assembly 2000 includes a first outlet 2080 configured to discharge the first part 2060 of the drilling fluid that contacted the low flow bearing 2030 externally to the bearing assembly 2000, such as through drill bit section 2090 and externally 2100 to the drill bit section 2090. The bearing assembly 2060 includes a bypass outlet 2110 configured to discharge the second part 2070 of the drilling fluid that flowed through the bypass channel 2050 externally 2120 to the bearing assembly 2000.

Drilling Fluid.

A drilling fluid, also known as a drilling mud or simply "mud," is a specially designed fluid that is circulated through a wellbore as the wellbore is being drilled to facilitate the drilling operation. The drilling fluid can be water-based or oil-based. The drilling fluid can carry cuttings up from beneath and around the bit, transport them up the annulus, and allow their separation. Also, a drilling fluid can cool and lubricate the drill bit as well as reduce friction between the drill string and the sides of the hole. The drilling fluid aids in support of the drill pipe and drill bit, and provides a hydrostatic head to maintain the integrity of the wellbore walls and prevent well blowouts. Specific drilling fluid systems can be selected to optimize a drilling operation in accordance with the characteristics of a particular geological formation. The drilling fluid can be formulated to prevent unwanted influxes of formation fluids from permeable rocks and also to form a thin, low permeability filter cake that temporarily seals pores, other openings, and formations penetrated by the bit. In water-based drilling fluids, solid particles are suspended in a water or brine solution containing other components. Oils or other non-aqueous liquids can be emulsified in the water or brine or at least partially solubilized (for less hydrophobic non-aqueous liquids), but water is the continuous phase.

A water-based drilling fluid in embodiments of the present invention can be any suitable water-based drilling fluid. In various embodiments, the drilling fluid can include at least one of water (fresh or brine), a salt (e.g., calcium chloride, sodium chloride, potassium chloride, magnesium chloride, calcium bromide, sodium bromide, potassium bromide, calcium nitrate, sodium formate, potassium formate, cesium formate), aqueous base (e.g., sodium hydroxide or potassium hydroxide), alcohol or polyol, cellulose, starches, alkalinity control agents, density control agents such as a density modifier (e.g., barium sulfate), surfactants (e.g., betaines, alkali metal alkylene acetates, sultaines, ether carboxylates), emulsifiers, dispersants, polymeric stabilizers, crosslinking agents, polyacrylamides, polymers or combinations of polymers, antioxidants, heat stabilizers, foam control agents, solvents, diluents, plasticizers, filler or inorganic particles (e.g., silica), pigments, dyes, precipitating agents (e.g., silicates or aluminum complexes), and rheology modifiers such as thickeners or viscosifiers (e.g., xanthan gum, laponite gels, geltones, sepiolite gel, TAU-MOD®). Any ingredient listed in this paragraph can be either present or not present in the mixture.

An oil-based drilling fluid or mud in embodiments of the present invention can be any suitable oil-based drilling fluid. In various embodiments the drilling fluid can include at least one of an oil-based fluid (or synthetic fluid), saline, aqueous solution, emulsifiers, other agents or additives for suspension control, weight or density control, oil-wetting agents, fluid loss or filtration control agents, and rheology control agents. An oil-based or invert emulsion-based drilling fluid can include between about 10:90 to about 95:5, or about 50:50 to about 95:5, by volume of oil phase to water phase. A substantially all oil mud includes about 100% liquid phase oil by volume (e.g., substantially no internal aqueous phase).

The drilling fluid can include any suitable carrier fluid, such as crude oil, dipropylene glycol methyl ether, dipropylene glycol dimethyl ether, dipropylene glycol methyl ether, dipropylene glycol dimethyl ether, dimethyl formamide, diethylene glycol methyl ether, ethylene glycol butyl ether, diethylene glycol butyl ether, butylglycidyl ether, propylene carbonate, D-limonene, a $C_2$-$C_{40}$ fatty acid $C_1$-$C_{10}$ alkyl ester (e.g., a fatty acid methyl ester), tetrahydrofurfuryl methacrylate, tetrahydrofurfuryl acrylate, 2-butoxy ethanol, butyl acetate, butyl lactate, furfuryl acetate, dimethyl sulfoxide, dimethyl formamide, a petroleum distillation product or fraction (e.g., diesel, kerosene, napthas, and the like) mineral oil, a hydrocarbon oil, a hydrocarbon including an aromatic carbon-carbon bond (e.g., benzene, toluene), a hydrocarbon including an alpha olefin, xylenes, an ionic liquid, methyl ethyl ketone, an ester of oxalic, maleic or succinic acid, methanol, ethanol, propanol (iso- or normal-), butyl alcohol (iso-, tert-, or normal-), an aliphatic hydrocarbon (e.g., cyclohexanone, hexane), water, brine, produced water, flowback water, brackish water, and sea water. The carrier fluid can form about 0.001 wt % to about 99.999 wt % of the drilling fluid, or about 0.001 wt % or less, or less than, equal to, or greater than about 0.01 wt %, 0.1, 1, 2, 3, 4, 5, 6, 8, 10, 15, 20, 25, 30, 35, 40, 45, 50, 55, 60, 65, 70, 75, 80, 85, 90, 95, 96, 97, 98, 99, 99.9, 99.99, or about 99.999 wt % or more.

In some embodiments, the drilling fluid can include any suitable amount of any suitable material used in a downhole fluid. For example, the drilling fluid can include water, saline, aqueous base, acid, oil, organic solvent, synthetic fluid oil phase, aqueous solution, alcohol or polyol, cellulose, starch, alkalinity control agents, acidity control agents, density control agents, density modifiers, emulsifiers, dispersants, polymeric stabilizers, polyacrylamide, a polymer or combination of polymers, antioxidants, heat stabilizers, foam control agents, solvents, diluents, plasticizer, filler or inorganic particle, pigment, dye, precipitating agent, oil-wetting agents, set retarding additives, surfactants, gases, weight reducing additives, heavy-weight additives, lost circulation materials, filtration control additives, salts (e.g., any suitable salt, such as potassium salts such as potassium chloride, potassium bromide, potassium formate; calcium salts such as calcium chloride, calcium bromide, calcium formate; cesium salts such as cesium chloride, cesium bromide, cesium formate, or a combination thereof), fibers, thixotropic additives, breakers, crosslinkers, rheology modifiers, curing accelerators, curing retarders, pH modifiers, chelating agents, scale inhibitors, enzymes, resins, water control materials, oxidizers, markers, Portland cement, pozzolana cement, gypsum cement, high alumina content cement, slag cement, silica cement, fly ash, metakaolin, shale, zeolite, a crystalline silica compound, amorphous silica, hydratable clays, microspheres, lime, or a combination thereof. In various embodiments, the drilling fluid can include one or more additive components such as: COLDTROL®, ATC®, OMC 2™, and OMC 42™ thinner additives; RHEMOD™ viscosifier and suspension agent; TEMPERUS™ and VIS-PLUS® additives for providing temporary increased viscosity; TAU-MOD™ viscosifying/suspension agent; ADAPTA®, DURATONE® HT, THERMO TONE™, BDF™-366, and BDF™-454 filtration control agents; LIQUITONE™ polymeric filtration agent and viscosifier; FACTANT™ emulsion stabilizer; LE SUPERMUL™, EZ MUL® NT, and FORTI-MUL® emulsifiers; DRIL TREAT® oil wetting agent for heavy fluids; AQUATONE-S™ wetting agent; BARACARB® bridging agent; BAROID® weighting agent; BAROLIFT® hole sweeping agent; SWEEP-WATE® sweep weighting agent; BDF-508 rheology modifier; and GELTONE® II organophilic clay. In various embodiments, the drilling fluid can include one or more additive components such as: X-TEND® II, PAC™-R, PAC™-L, LIQUI-VIS® EP, BRINEDRIL-VIS™, BARAZAN®, N-VIS®, and AQUA-GEL® viscosifiers; THERMA-CHEK®, N-DRIL™, N-DRIL™ HT PLUS, IMPERMEX®, FILTERCHEK™, DEXTRID®, CARBONOX®, and BARANEX® filtration control agents; PERFORMATROL®, GEM™, EZ-MUD®, CLAY GRABBER®, CLAYSEAL®, CRYSTAL-DRIL®, and CLAY SYNC™ II shale stabilizers; NXS-LUBE™ EP MUDLUBE®, and DRIL-N-SLIDE™ lubricants; QUIK-THIN®, IRON-THIN™, THERMA-THIN®, and ENVIRO-THIN™ thinners; SOURSCAV™ scavenger; BARACOR® corrosion inhibitor; and WALL-NUT®, SWEEP-WATE®, STOPPIT™, PLUG-GIT®, BARACARB®, DUO-SQUEEZE®, BAROFIBRE™, STEEL-SEAL®, and HYDRO-PLUG® lost circulation management materials. Any suitable proportion of the drilling fluid can include any optional component listed in this paragraph, such as about 0.001 wt % to about 99.999 wt %, about 0.01 wt % to about 99.99 wt %, about 0.1 wt % to about 99.9 wt %, about 20 to about 90 wt %, or about 0.001 wt % or less, or less than, equal to, or greater than about 0.01 wt %, 0.1, 1, 2, 3, 4, 5, 10, 15, 20, 30, 40, 50, 60, 70, 80, 85, 90, 91, 92, 93, 94, 95, 96, 97, 98, 99, 99.9, 99.99 wt %, or about 99.999 wt % or more.

Drilling Assembly.

Figure 4:
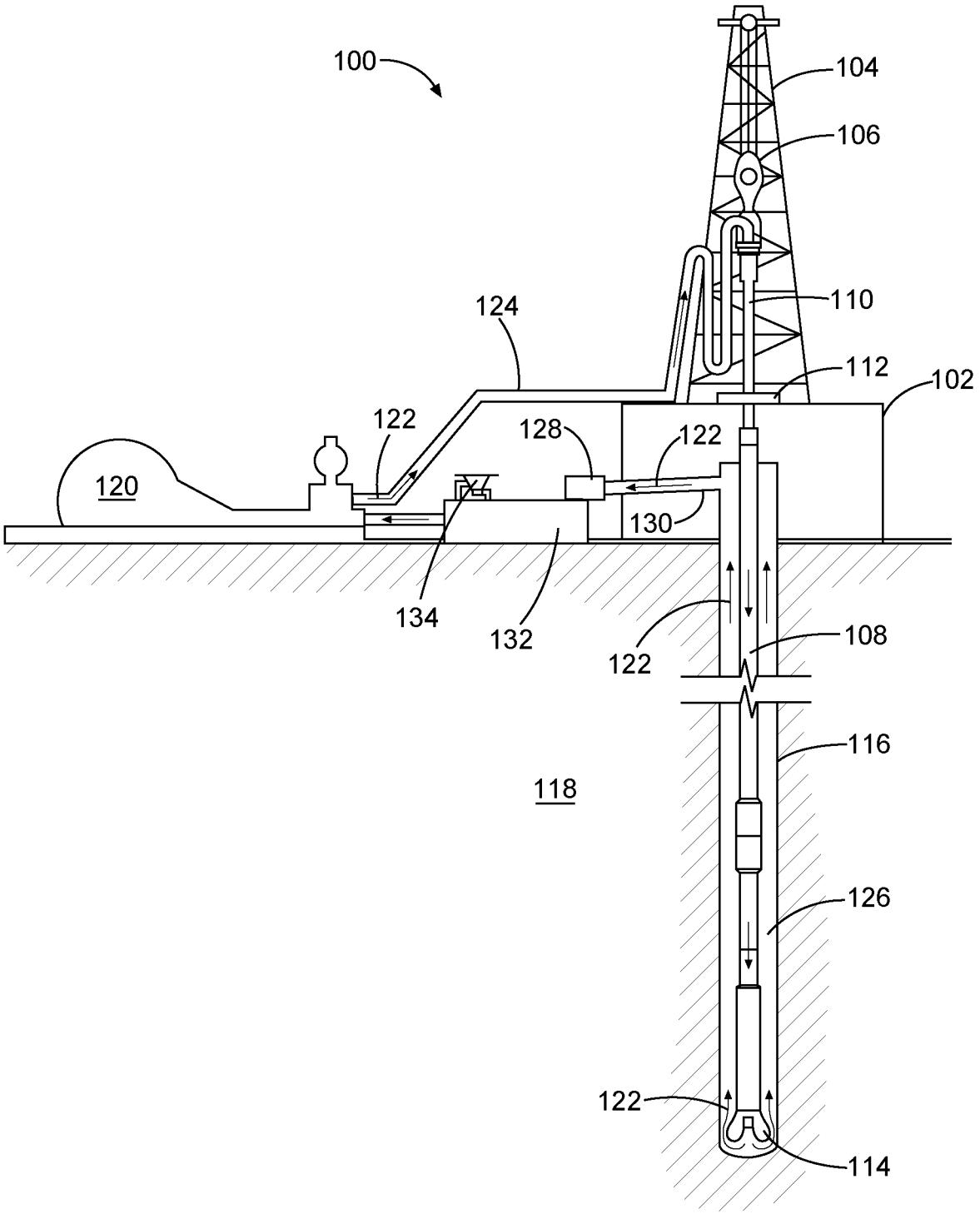
FIG. 4 illustrates a drilling assembly, in accordance with various embodiments.

In various embodiments, the bearing assembly can be part of a drilling assembly. For example, and with reference to FIG. 4, the bearing assembly can be used together with one or more components or pieces of equipment associated with an exemplary wellbore drilling assembly 100, according to one or more embodiments. It should be noted that while FIG. 4 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 100 can include a drilling platform 102 that supports a derrick 104 having a traveling block 106 for raising and lowering a drill string 108. The drill string 108 can include drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a wellbore 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and can be conveyed to one or more fluid processing unit(s) 128 via an interconnecting flow line 130. After passing through the fluid processing unit(s) 128, a "cleaned" drilling fluid 122 is deposited into a nearby retention pit 132 (e.g., a mud pit). While the fluid processing unit(s) 128 is illustrated as being arranged at the outlet of the wellbore 116 via the annulus 126, those skilled in the art will readily appreciate that the fluid processing unit(s) 128 can be arranged at any other location in the drilling assembly 100 to facilitate its proper function, without departing from the scope of the disclosure.

The pump 120 can be a high pressure pump in some embodiments. As used herein, the term "high pressure pump" will refer to a pump that is capable of delivering a fluid to a subterranean formation (e.g., downhole) at a pressure of about 1000 psi or greater. Suitable high pressure pumps will be known to one having ordinary skill in the art and can include floating piston pumps and positive displacement pumps. In other embodiments, the pump can be a low pressure pump. As used herein, the term "low pressure pump" will refer to a pump that operates at a pressure of about 1000 psi or less. In some embodiments, a low pressure pump can be fluidly coupled to a high pressure pump that is fluidly coupled to the tubular. That is, in such embodiments, the low pressure pump can be configured to convey the drilling fluid to the high pressure pump. In such embodiments, the low pressure pump can "step up" the pressure of the drilling fluid before it reaches the high pressure pump.

Mixing hopper 134 is communicably coupled to or otherwise in fluid communication with the retention pit 132. The mixing hopper 134 can include mixers and related mixing equipment known to those skilled in the art. In at least one embodiment, for example, there could be more than one retention pit 132, such as multiple retention pits 132 in series.

Fluid processing unit(s) 128 can include one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, or any fluid reclamation equipment. The fluid processing unit(s) 128 can further include one or more sensors, gauges, pumps, compressors, and the like used to store, monitor, regulate, and/or recondition the drilling fluid.

The pump 120 representatively includes any conduits, pipelines, trucks, tubulars, and/or pipes used to fluidically convey the drilling fluid to the subterranean formation; any pumps, compressors, or motors (e.g., topside or downhole) used to drive the drilling fluid into motion; any valves or related joints used to regulate the pressure or flow rate of the drilling fluid; and any sensors (e.g., pressure, temperature, flow rate, and the like), gauges, and/or combinations thereof, and the like.

The drilling apparatus can include any suitable equipment or tools used for drilling subterranean formation. Such equipment and tools can include wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the systems and apparatuses generally described above and depicted in FIG. 4.

System for Drilling a Subterranean Formation.

In various embodiments, the present invention provides a system for drilling a subterranean formation. The system can be any suitable system that can perform an embodiment of the method of drilling a subterranean formation described herein, or that includes an embodiment of the bearing assembly for drilling a subterranean formation described herein.

The system can include a pump configured to pump a drilling fluid in a drill string disposed in the subterranean formation. The system can include a bottom hole assembly at the downhole end of the drilling string. The bottom hole assembly can include a bearing assembly. The bearing assembly can include an inlet configured to flow the drilling fluid into the bearing assembly. The bearing assembly can include a low flow bearing. The bearing assembly can include a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing. The bearing assembly can include a first outlet configured to discharge the first part of the drilling fluid that contacted the low flow bearing externally to the bearing assembly. The bearing assembly can include a bypass outlet configured to discharge the second part of the drilling fluid that flowed through the bypass channel externally to the bearing assembly.

In some embodiments, the system can include a drill string disposed in a wellbore, with the drill string including a drill bit at a downhole end of the drill string. The system can also include an annulus between the drill string and the wellbore. The system can also include a pump configured to circulate the composition through the drill string, through the drill bit, and back above-surface through the annulus. In some embodiments, the system can include a fluid processing unit configured to process the composition exiting the annulus to generate a cleaned drilling fluid for recirculation through the wellbore.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments.

The following exemplary embodiments are provided, the numbering of which is not to be construed as designating levels of importance:

Embodiment 1 provides a method of drilling a subterranean formation, the method comprising:

flowing a drilling fluid through a drill string disposed in the subterranean formation, the drill string comprising a bottom hole assembly comprising a bearing assembly comprising a low flow bearing;

flowing a first part of the drilling fluid into contact with the low flow bearing, while simultaneously flowing a second part of the drilling fluid through a bypass channel around the low flow bearing; and discharging the first and second part of the drilling fluid between the bottom hole assembly and the subterranean formation.

Embodiment 2 provides the method of Embodiment 1, wherein the bottom hole assembly further comprises a power section and a drill bit section.

Embodiment 3 provides the method of any one of Embodiments 1-2, further comprising flowing the drilling fluid through a power section of the bottom hole assembly before flowing the first part of the drilling fluid into contact with the low flow bearing and flowing the second part of the drilling fluid through the bypass channel around the low flow bearing.

Embodiment 4 provides the method of any one of Embodiments 1-3, wherein flowing the first part of the drilling fluid into contact with the low flow bearing comprises contacting the first part of the drilling fluid with bearing surfaces of the low flow bearing, surfaces adjacent to bearing surfaces of the low flow bearing, or a combination thereof.

Embodiment 5 provides the method of any one of Embodiments 1-4, wherein flowing the first part of the drilling fluid into contact with the low flow bearing comprises cooling the low flow bearing with the first part of the drilling fluid, lubricating the low flow bearing with the first part of the drilling fluid, or a combination thereof.

Embodiment 6 provides the method of any one of Embodiments 1-5, wherein the low flow bearing is a radial bearing, a thrust bearing, an on-bottom bearing, an off-bottom bearing, or a combination thereof.

Embodiment 7 provides the method of any one of Embodiments 1-6, wherein the low flow bearing is a radial bearing.

Embodiment 8 provides the method of any one of Embodiments 1-7, wherein the low flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

Embodiment 9 provides the method of any one of Embodiments 1-8, wherein the low flow bearing comprises pucks comprising tungsten carbide, wherein each puck comprises a bearing surface of the low flow bearing.

Embodiment 10 provides the method of any one of Embodiments 1-9, wherein at least one bearing surface of the low flow bearing comprises diamond.

Embodiment 11 provides the method of any one of Embodiments 1-10, wherein the low flow bearing is a polycrystalline diamond compact (PDC) bearing assembly.

Embodiment 12 provides the method of any one of Embodiments 1-11, wherein during the flowing of the second part of the drilling fluid through the bypass channel around the low flow bearing, the low flow bearing is substantially free of lubrication and cooling from the second part of the drilling fluid.

Embodiment 13 provides the method of any one of Embodiments 1-12, wherein during the flowing of the second part of the drilling fluid through the bypass channel around the low flow bearing, the low flow bearing is substantially free of contact with the second part of the drilling fluid.

Embodiment 14 provides the method of any one of Embodiments 1-13, wherein flowing the second part of the drilling fluid through the bypass channel comprises flowing the second part of the drilling fluid externally to the low flow bearing and internally to the bottom hole assembly.

Embodiment 15 provides the method of any one of Embodiments 1-14, comprising flowing a first part of the drilling fluid into contact with the low flow bearing, while simultaneously flowing a second part of the drilling fluid through a plurality of bypass channels around the low flow bearing.

Embodiment 16 provides the method of any one of Embodiments 1-15, wherein the low flow bearing is at a downhole end of the bearing assembly proximate to a drill bit section.

Embodiment 17 provides the method of any one of Embodiments 1-16, wherein the low flow bearing is more proximate to the drill bit section than any other bearing in the bearing assembly.

Embodiment 18 provides the method of any one of Embodiments 1-17, wherein the bearing assembly comprises a plurality of low flow bearings, wherein the method comprises flowing the first part of the drilling fluid into contact with each of the plurality of the low flow bearings, while simultaneously flowing a second part of the drilling fluid through the bypass channel around each of the low flow bearings.

Embodiment 19 provides the method of any one of Embodiments 1-18, wherein the bearing assembly further comprises a high flow bearing.

Embodiment 20 provides the method of Embodiment 19, further comprising flowing the first and second part of the drilling fluid together into contact with the high flow bearing.

Embodiment 21 provides the method of any one of Embodiments 19-20, further comprising flowing the first and second part of the drilling fluid together into contact with the high flow bearing before simultaneously flowing the first part of the drilling fluid into contact with the low flow bearing and flowing the second part of the drilling fluid through the bypass channel around the low flow bearing.

Embodiment 22 provides the method of any one of Embodiments 19-21, wherein the bearing assembly comprises a plurality of high flow bearings.

Embodiment 23 provides the method of Embodiment 22, further comprising flowing the first and second part of the drilling fluid together into contact with the plurality of high flow bearings before simultaneously flowing the first part of the drilling fluid into contact with the low flow bearing and flowing the second part of the drilling fluid through the bypass channel around the low flow bearing.

Embodiment 24 provides the method of any one of Embodiments 19-23, wherein flowing the first and second parts of the drilling fluid together into contact with the high flow bearing comprises contacting the first and second parts of the drilling fluid together with bearing surfaces of the high flow bearing, surfaces adjacent to bearing surfaces of the high flow bearing, or a combination thereof.

Embodiment 25 provides the method of any one of Embodiments 19-24, wherein flowing the first and second parts of the drilling fluid together into contact with the high flow bearing comprises cooling the high flow bearing with the first and second parts of the drilling fluid, lubricating the high flow bearing with the first and second parts of the drilling fluid, or a combination thereof.

Embodiment 26 provides the method of any one of Embodiments 19-25, wherein the high flow bearing is a plain bushing, a radial bearing, a thrust bearing, an on-bottom bearing, an off-bottom bearing, or a combination thereof.

Embodiment 27 provides the method of any one of Embodiments 19-26, wherein the high flow bearing is a plain bushing.

Embodiment 28 provides the method of any one of Embodiments 19-27, wherein the high flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

Embodiment 29 provides the method of any one of Embodiments 19-28, wherein the high flow bearing comprises tungsten carbide.

Embodiment 30 provides the method of any one of Embodiments 19-29, wherein a central axis of the high flow bearing is approximately aligned with a central axis of the low flow bearing.

Embodiment 31 provides the method of any one of Embodiments 19-30, wherein the low flow bearing is more proximate to the drill bit section than the high flow bearing.

Embodiment 32 provides the method of any one of Embodiments 1-31, wherein discharging the first and second part of the drilling fluid between the bottom hole assembly and the subterranean formation comprises discharging the first and second part of the drilling fluid to different locations.

Embodiment 33 provides the method of any one of Embodiments 1-32, wherein discharging the first and second part of the drilling fluid between the bottom hole assembly and the subterranean formation comprises flowing the first part of the drilling fluid into a drill bit section of the bottom hole assembly, and then discharging the first part of the drilling fluid from the drill bit section to between the bottom hole assembly and the subterranean formation.

Embodiment 34 provides the method of any one of Embodiments 1-33, wherein discharging the first and second part of the drilling fluid between the bottom hole assembly and the subterranean formation comprises discharging the second part of the drilling fluid to between the bottom hole assembly and the subterranean formation without flowing the second part of the drilling fluid into a drill bit section of the bottom hole assembly.

Embodiment 35 provides the method of any one of Embodiments 1-34, wherein discharging the first and second part of the drilling fluid between the bottom hole assembly and the subterranean formation comprises discharging the second part of the drilling fluid between the bottom hole assembly and the subterranean formation through a bypass outlet in the bottom hole assembly.

Embodiment 36 provides the method of any one of Embodiments 1-35, wherein the bypass outlet is uphole of a drill bit section of the bottom hole assembly.

Embodiment 37 provides a method of drilling a subterranean formation, the method comprising:

flowing a drilling fluid through a drill string disposed in the subterranean formation, the drill string comprising a bottom hole assembly comprising a bearing assembly and a drill bit section, wherein the drill bit section is at a downhole end of the bottom hole assembly, the bearing assembly comprises a high flow bearing and a low flow bearing, the low flow bearing is more proximate to the drill bit section than the high flow bearing, and at least one bearing surface of the low flow bearing comprises diamond;

flowing a first part of the drilling fluid and a second part of the drilling fluid together into contact with the high flow bearing, comprising cooling the high flow bearing with the first and second parts of the drilling fluid, lubricating the high flow bearing with the first and second parts of the drilling fluid, or a combination thereof;

flowing the first part of the drilling fluid into contact with the low flow bearing, comprising cooling the low flow bearing with the first part of the drilling fluid, lubricating the low flow bearing with the first part of the drilling fluid, or a combination thereof, while simultaneously flowing the second part of the drilling fluid through a bypass channel around the low flow bearing; and discharging the first and second part of the drilling fluid between the bottom hole assembly and the subterranean formation.

Embodiment 38 provides a bearing assembly for drilling a subterranean formation, the bearing assembly comprising:

an inlet configured to flow a drilling fluid into the bearing assembly;

a low flow bearing;

a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing;

a first outlet configured to discharge the first part of the drilling fluid that contacted the low flow bearing externally to the bearing assembly; and a bypass outlet configured to discharge the second part of the drilling fluid that flowed through the bypass channel externally to the bearing assembly.

Embodiment 39 provides the bearing assembly of Embodiment 38, wherein flowing the first part of the drilling fluid into contact with the low flow bearing comprises cooling the low flow bearing with the first part of the drilling fluid, lubricating the low flow bearing with the first part of the drilling fluid, or a combination thereof.

Embodiment 40 provides the bearing assembly of any one of Embodiments 38-39, wherein flowing the first part of the drilling fluid into contact with the low flow bearing comprises contacting the first part of the drilling fluid with bearing surfaces of the low flow bearing, surfaces adjacent to bearing surfaces of the low flow bearing, or a combination thereof.

Embodiment 41 provides the bearing assembly of any one of Embodiments 38-40, wherein the low flow bearing is a radial bearing, a thrust bearing, an on-bottom bearing, an off-bottom bearing, or a combination thereof.

Embodiment 42 provides the bearing assembly of any one of Embodiments 38-41, wherein the low flow bearing is a radial bearing.

Embodiment 43 provides the bearing assembly of any one of Embodiments 38-42, wherein the low flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

Embodiment 44 provides the bearing assembly of any one of Embodiments 38-43, wherein the low flow bearing comprises pucks comprising tungsten carbide, wherein each puck comprises a bearing surface of the low flow bearing.

Embodiment 45 provides the bearing assembly of any one of Embodiments 38-44, wherein at least one bearing surface of the low flow bearing comprises diamond.

Embodiment 46 provides the bearing assembly of any one of Embodiments 38-45, wherein the low flow bearing is a polycrystalline diamond compact (PDC) bearing assembly.

Embodiment 47 provides the bearing assembly of any one of Embodiments 38-46, wherein during the flowing of the second part of the drilling fluid through the bypass channel around the low flow bearing, the bearing assembly is configured such that the low flow bearing is substantially free of lubrication and cooling from the second part of the drilling fluid.

Embodiment 48 provides the bearing assembly of any one of Embodiments 38-47, wherein during the flowing of the second part of the drilling fluid through the bypass channel around the low flow bearing, the bearing assembly is configured such that the low flow bearing is substantially free of contact with the second part of the drilling fluid.

Embodiment 49 provides the bearing assembly of any one of Embodiments 38-48, wherein the bypass channel is external to the low flow bearing and internal to the bearing assembly.

Embodiment 50 provides the bearing assembly of any one of Embodiments 38-49, comprising a plurality of the bypass channels, the bypass channels together configured to flow a first part of the drilling fluid flowed into the bearing assembly into contact with the low flow bearing and to simultaneously flow a second part of the drilling fluid flowed into the bearing assembly through the bypass channels around the low flow bearing.

Embodiment 51 provides the bearing assembly of any one of Embodiments 38-50, wherein an end of the bearing assembly opposite the inlet comprises the low flow bearing.

Embodiment 52 provides the bearing assembly of any one of Embodiments 38-51, wherein the low flow bearing is configured to be more proximate to a drill bit section than any other bearing in the bearing assembly.

Embodiment 53 provides the bearing assembly of any one of Embodiments 38-52, wherein the bearing assembly comprises a plurality of low flow bearings, wherein the bypass channel is configured to flow a first part of the drilling fluid flowed into the bearing assembly into contact with the plurality of low flow bearings and to simultaneously flow a second part of the drilling fluid flowed into the bearing assembly through the bypass channel around the plurality of low flow bearings.

Embodiment 54 provides the bearing assembly of any one of Embodiments 38-53, further comprising a high flow bearing.

Embodiment 55 provides the bearing assembly of Embodiment 54, configured to flow the first and second part of the drilling fluid together into contact with the high flow bearing.

Embodiment 56 provides the bearing assembly of any one of Embodiments 54-55, configured to flow the first and second part of the drilling fluid together into contact with the high flow bearing and to subsequently simultaneously flow the first part of the drilling fluid into contact with the low flow bearing and flow the second part of the drilling fluid through the bypass channel around the low flow bearing.

Embodiment 57 provides the bearing assembly of any one of Embodiments 54-56, comprising a plurality of high flow bearings.

Embodiment 58 provides the bearing assembly of Embodiment 57, wherein the bearing assembly is configured to flow the first and second part of the drilling fluid together into contact with the plurality of high flow bearings and to subsequently simultaneously flow the first part of the drilling fluid into contact with the low flow bearing and flow the second part of the drilling fluid through the bypass channel around the low flow bearing.

Embodiment 59 provides the bearing assembly of any one of Embodiments 54-58, wherein during the flowing of the first and second parts of the drilling fluid together into contact with the high flow bearing, the bearing assembly is configured such that the first and second parts of the drilling fluid together contact with bearing surfaces of the high flow bearing, surfaces adjacent to bearing surfaces of the high flow bearing, or a combination thereof.

Embodiment 60 provides the bearing assembly of any one of Embodiments 54-59, wherein during the flowing of the first and second parts of the drilling fluid together into contact with the high flow bearing, the bearing assembly is configured such that the high flow bearing is cooled with the first and second parts of the drilling fluid, the high flow bearing is lubricated with the first and second parts of the drilling fluid, or a combination thereof.

Embodiment 61 provides the bearing assembly of any one of Embodiments 54-60, wherein the high flow bearing is a plain bushing, a radial bearing, a thrust bearing, an on-bottom bearing, an off-bottom bearing, or a combination thereof.

Embodiment 62 provides the bearing assembly of any one of Embodiments 54-61, wherein the high flow bearing is a plain bushing.

Embodiment 63 provides the bearing assembly of any one of Embodiments 54-62, wherein the high flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

Embodiment 64 provides the bearing assembly of any one of Embodiments 54-63, wherein the high flow bearing comprises tungsten carbide.

Embodiment 65 provides the bearing assembly of any one of Embodiments 54-64, wherein a central axis of the high flow bearing is approximately aligned with a central axis of the low flow bearing.

Embodiment 66 provides the bearing assembly of any one of Embodiments 54-65, wherein the high flow bearing is more proximate to an end of the bearing assembly comprising the inlet than the low flow bearing.

Embodiment 67 provides the bearing assembly of any one of Embodiments 54-66, wherein the low flow bearing is configured to be more proximate to a drill bit section than the high flow bearing.

Embodiment 68 provides the bearing assembly of any one of Embodiments 38-67, wherein the first outlet is configured to discharge the first part of the drilling fluid that contacted the low flow bearing to a drill bit section.

Embodiment 69 provides the bearing assembly of any one of Embodiments 38-68, wherein the bypass outlet is configured to discharge the second part of the drilling fluid that flowed through the bypass channel between the bottom hole assembly and the subterranean formation.

Embodiment 70 provides a bearing assembly for drilling a subterranean formation, the bearing assembly comprising:

an inlet configured to flow a first and second part of a drilling fluid into the bearing assembly;

a low flow bearing;

a high flow bearing, wherein the bearing assembly is configured to flow the first part and the second part of the drilling fluid flowed into the bearing assembly through the inlet into contact with the high flow bearing, to cool the high flow bearing with the first and second parts of the drilling fluid, to lubricate the high flow bearing with the first and second parts of the drilling fluid, or a combination thereof;

a bypass channel configured to flow the first part of the drilling fluid that has contacted the high flow bearing into contact with the low flow bearing to cool the low flow bearing with the first part of the drilling fluid, lubricate the low flow bearing with the first part of the drilling fluid, or a combination thereof, and to simultaneously flow the second part of the drilling fluid that has contacted the high flow bearing through the bypass channel around the low flow bearing;

a first outlet configured to discharge the first part of the drilling fluid that contacted the low flow bearing externally to the bearing assembly; and a bypass outlet configured to discharge the second part of the drilling fluid that flowed through the bypass channel externally to the bearing assembly.

Embodiment 71 provides a system for drilling a subterranean formation, the system comprising:

a pump configured to pump a drilling fluid in a drill string disposed in the subterranean formation; and a bottom hole assembly at the downhole end of the drilling string, the bottom hole assembly comprising a bearing assembly, the bearing assembly comprising an inlet configured to flow the drilling fluid into the bearing assembly;

a low flow bearing;

a bypass channel configured to flow a first part of the drilling fluid flowed into the bearing assembly into contact with the low flow bearing and to simultaneously flow a second part of the drilling fluid flowed into the bearing assembly through the bypass channel around the low flow bearing;

a first outlet configured to discharge the first part of the drilling fluid that contacted the low flow bearing externally to the bearing assembly; and a bypass outlet configured to discharge the second part of the drilling fluid that flowed through the bypass channel externally to the bearing assembly.

Embodiment 72 provides the method, bearing assembly, or system of any one or any combination of Embodiments 1-71 optionally configured such that all elements or options recited are available to use or select from.

What is claimed is:

1. A method of drilling a subterranean formation, the method comprising:

flowing a drilling fluid through a drill string disposed in the subterranean formation, the drill string comprising a bottom hole assembly comprising a bearing assembly comprising a low flow bearing and a high flow bearing;

flowing a first part of the drilling fluid into contact with the low flow bearing, while simultaneously flowing a second part of the drilling fluid through a bypass channel around the outer diameter of the low flow bearing;

flowing the first and second parts of the drilling fluid together into contact with the high flow bearing; and discharging the first and second part of the drilling fluid between the bottom hole assembly and the subterranean formation.

2. The method of claim 1, wherein flowing the first part of the drilling fluid into contact with the low flow bearing comprises cooling the low flow bearing with the first part of the drilling fluid, lubricating the low flow bearing with the first part of the drilling fluid, or a combination thereof.

3. The method of claim 1, wherein the low flow bearing is a radial bearing, a thrust bearing, an on-bottom bearing, an off-bottom bearing, or a combination thereof.

4. The method of claim 1, wherein the low flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

5. The method of claim 1, wherein at least one bearing surface of the low flow bearing comprises diamond.

6. The method of claim 1, wherein during the flowing of the second part of the drilling fluid through the bypass channel around the low flow bearing, the low flow bearing is free of lubrication and cooling from the second part of the drilling fluid.

7. The method of claim 1, comprising flowing a first part of the drilling fluid into contact with the low flow bearing, while simultaneously flowing a second part of the drilling fluid through a plurality of bypass channels around the low flow bearing.

8. The method of claim 1, wherein the low flow bearing is at a downhole end of the bearing assembly proximate to a drill bit section.

9. The method of claim 1, wherein the low flow bearing is more proximate to the drill bit section than any other bearing in the bearing assembly.

10. The method of claim 1, wherein the bearing assembly comprises a plurality of low flow bearings, wherein the method comprises flowing the first part of the drilling fluid into contact with each of the plurality of the low flow bearings, while simultaneously flowing a second part of the drilling fluid through the bypass channel around each of the low flow bearings.

11. The method of claim 1, further comprising flowing the first and second part of the drilling fluid together into contact with the high flow bearing before simultaneously flowing the first part of the drilling fluid into contact with the low flow bearing and flowing the second part of the drilling fluid through the bypass channel around the low flow bearing.

12. The method of claim 1, wherein the bearing assembly comprises a plurality of high flow bearings, further comprising flowing the first and second part of the drilling fluid together into contact with the plurality of high flow bearings before simultaneously flowing the first part of the drilling fluid into contact with the low flow bearing and flowing the second part of the drilling fluid through the bypass channel around the low flow bearing.

13. The method of claim 1, wherein flowing the first and second parts of the drilling fluid together into contact with the high flow bearing comprises cooling the high flow bearing with the first and second parts of the drilling fluid, lubricating the high flow bearing with the first and second parts of the drilling fluid, or a combination thereof.

14. The method of claim 1, wherein the high flow bearing is a plain bushing, a radial bearing, a thrust bearing, an on-bottom bearing, an off-bottom bearing, or a combination thereof.

15. The method of claim 1, wherein the high flow bearing comprises cobalt, a cobalt alloy, carbon fiber, silicon nitride, boron nitride, silicon carbide, boron carbide, tungsten carbide, tantalum carbide, titanium carbide, titanium boride, diamond, polycrystalline diamond, or a combination thereof.

16. The method of claim 1, wherein a central axis of the high flow bearing is approximately aligned with a central axis of the low flow bearing.

17. A method of drilling a subterranean formation, the method comprising:

flowing a drilling fluid through a drill string disposed in the subterranean formation, the drill string comprising a bottom hole assembly comprising a bearing assembly and a drill bit section, wherein the drill bit section is at a downhole end of the bottom hole assembly, the bearing assembly comprises a high flow bearing and a low flow bearing, the low flow bearing is more proximate to the drill bit section than the high flow bearing, and at least one bearing surface of the low flow bearing comprises diamond;

flowing a first part of the drilling fluid and a second part of the drilling fluid together into contact with the high flow bearing, comprising cooling the high flow bearing with the first and second parts of the drilling fluid, lubricating the high flow bearing with the first and second parts of the drilling fluid, or a combination thereof;

flowing the first part of the drilling fluid into contact with the low flow bearing, comprising cooling the low flow bearing with the first part of the drilling fluid, lubricating the low flow bearing with the first part of the drilling fluid, or a combination thereof, while simultaneously flowing the second part of the drilling fluid through a bypass channel around the outer diameter of the low flow bearing; and discharging the first and second part of the drilling fluid between the bottom hole assembly and the subterranean formation.

18. A bearing assembly for drilling a subterranean formation, the bearing assembly comprising:

an inlet configured to flow a drilling fluid into the bearing assembly;

a low flow bearing;

a high flow bearing wherein the bearing assembly is configured to flow first and second parts of the drilling fluid together into contact with the high flow bearing;

a bypass channel configured to the second part of the drilling fluid flowed into the bearing assembly through the bypass channel around the outer diameter of the low flow bearing while the first part of the drilling fluid flowed into the bearing assembly is simultaneously flowed into contact with the low flow bearing;

a first outlet configured to discharge the first part of the drilling fluid that contacted the low flow bearing externally to the bearing assembly; and a bypass outlet configured to discharge the second part of the drilling fluid that flowed through the bypass channel externally to the bearing assembly.

* * * * *